US011276941B2

(12) United States Patent
Kolitsidas et al.

(10) Patent No.: US 11,276,941 B2
(45) Date of Patent: Mar. 15, 2022

(54) BROADBAND ANTENNA

(71) Applicant: Telefonaktiebolaget LM Ericsson (publ), Stockholm (SE)

(72) Inventors: Christos Kolitsidas, Stockholm (SE); Petros Bantavis, Brest (FR); Stefan Engström, Värmdö (SE); Lars Jonsson, Vällingby (SE); Georgios A Kyriacou, Xanthi (GR)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 119 days.

(21) Appl. No.: 16/612,768

(22) PCT Filed: May 12, 2017

(86) PCT No.: PCT/SE2017/050483
§ 371 (c)(1),
(2) Date: Nov. 12, 2019

(87) PCT Pub. No.: WO2018/208196
PCT Pub. Date: Nov. 15, 2018

(65) Prior Publication Data

US 2021/0296787 A1 Sep. 23, 2021

(51) Int. Cl.
*H01Q 21/06* (2006.01)
*H01Q 21/24* (2006.01)
(Continued)

(52) U.S. Cl.
CPC ..... *H01Q 21/064* (2013.01); *H01Q 21/0006* (2013.01); *H01Q 21/24* (2013.01); *H01Q 1/246* (2013.01)

(58) Field of Classification Search
CPC ..... H01Q 21/064; H01Q 21/240006; H01Q 21/246
(Continued)

(56) References Cited

U.S. PATENT DOCUMENTS 3,603,987 A * 9/1971 Witte ..... H01Q 21/245 343/786
4,978,965 A * 12/1990 Mohuchy ..... H01Q 13/085 343/727
(Continued)

FOREIGN PATENT DOCUMENTS

GB 1601441 10/1981
JP 10-173432 A 6/1998
(Continued)

OTHER PUBLICATIONS

International Search Report and Written Opinion, PCT App. No. PCT/SE2017/050483, dated Feb. 6, 2018, 13 pages.
(Continued)

*Primary Examiner* — Lam T Mai
(74) *Attorney, Agent, or Firm* — NDWE LLP

(57) ABSTRACT

A single polarized radiator comprising a plurality of planar notch radiating elements arranged on a dielectric substrate. Each notch radiating element comprises: a metallized region on a first side of the dielectric substrate extending across the width of the notch radiating element from a forward edge of the notch radiating element to a rear edge of the notch radiating element, a tuning element in the metallized region adjacent to a feeding point of the notch radiating element, a notch extending from the tuning element to the forward edge of the notch radiating element thereby creating a notch profile, and a plurality of indentations in the metallized region along each side of the notch to extend the length of the notch profile.

18 Claims, 3 Drawing Sheets

(51) Int. Cl.
*H01Q 21/00* (2006.01)
*H01Q 1/24* (2006.01)

(58) Field of Classification Search
USPC ..... 343/770, 795, 767, 727, 797
See application file for complete search history.

(56) References Cited

U.S. PATENT DOCUMENTS

| | | | | |
|---|---|---|---|---|
| 6,008,770 | A | 12/1999 | Satoru | |
| 7,444,736 | B1 | 11/2008 | Warning | |
| 2002/0180655 | A1* | 12/2002 | Mohuchy | H01Q 21/24 343/770 |
| 2007/0152898 | A1 | 7/2007 | Mizuno et al. | |
| 2011/0234463 | A1* | 9/2011 | Lankes | H01Q 21/065 343/728 |
| 2012/0200470 | A1 | 8/2012 | Henry et al. | |
| 2013/0021218 | A1 | 1/2013 | Asanuma et al. | |
| 2014/0285388 | A1 | 9/2014 | Yeng | |

FOREIGN PATENT DOCUMENTS

| | | | |
|---|---|---|---|
| JP | 11-330846 | A | 11/1999 |
| JP | 2018-511240 | A | 4/2018 |
| WO | 2005/083839 | A1 | 9/2005 |
| WO | 2016/141177 | A1 | 9/2016 |

OTHER PUBLICATIONS

International Preliminary Report on Patentability, PCT App. No. PCT/SE2017/050483, dated Nov. 21, 2019, 10 pages.
Shin et al., "A Parameter Study of Stripline-Fed Vivaldi Notch-Antenna Arrays", IEEE Transactions on Antennas and Propagation, vol. 47, No. 5, May 1999, pp. 879-886.

* cited by examiner

BROADBAND ANTENNA

CROSS-REFERENCE TO RELATED APPLICATIONS

This application is a National stage of International Application No. PCT/SE2017/050483, filed May 12, 2017, which is hereby incorporated by reference.

TECHNICAL FIELD

The present disclosure relates to the field of wireless communication. In particular, it relates to broadband antennas comprising notch radiating elements.

BACKGROUND

Nodes in a wireless communication network require antennas for communication between the network and user equipment, UE, and the number of antennas varies depending on number of frequencies used, type of antenna used and how space diversity is implemented. The typical number of antennas per site is nine with three per sector. Current typical antennas are narrowband and divided into two categories, low band and mid/high band antennas. Low band covers 700-900 MHz frequency range while mid/high band covers 1700-2600 MHz. Operators are often renting site space for antennas from building landlords and tower owners, and the number of antennas, antenna size and weight are factors that determine the rental cost. More and bigger and heavier antennas results in higher rent.

One current solution to reduce number of antennas on a site is to combine low and mid/high band antennas into one antenna, known as multi band antenna. This method has drawbacks since the products become quite expensive and complicated. Since many frequency bands will be placed in same antenna this requires a lot of cabling and phase shifters, which are used for tilt. The material together with complicated building practice in order to achieve good performance results in an expensive product.

Dipole antennas are primarily used in narrowband technology in wireless communication systems. The dipoles are separated from each other to ensure that interaction between the dipoles is minimal, and each dipole array and polarization is interconnected to a common input/output port. Furthermore, each dipole is designed to cover a specific frequency band or a few bands close to each other, and a phase shifter is normally implemented per dipole to achieve vertical tilt for that dipole array. Electrical tilt is realized with an external box called Remote Electrical Tilt, RET. Realizing several frequency bands in a dipole antenna configuration requires several dipole arrays in the same antenna aperture.

An illustrative schematic of a dual polarized dual band dipole antenna 10 with phase shifters 11 operating at two different frequencies (denoted A and B) can be seen in FIG. 1. Two dual polarized antenna elements 12 are provided for each frequency, and are connected to antenna ports $\mathbf{13}_A$ and $\mathbf{13}_B$. The number of antenna elements will differ from antenna to antenna depending on antenna characteristics.

Narrowband antennas such as described above also cause an additional challenge if wideband radios are used. This results in additional duplexers creating more site cost and power consumption increases.

Communications are currently at a premium and an exponential growth in supported services is expected over the next few years. Next generation base stations are envisioned to be able to support all wireless commercial protocols. This requires operation over a wide frequency range.

Different technologies may be used for wide-band antenna arrays, e.g. tapered slot or Vivaldi arrays as disclosed in "A parameter study of stripline-fed vivaldi notch-antenna arrays" by J. Shin and D. H. Schaubert in IEEE Transactions on Antennas and Propagation, vol. 47, no 5, pp. 879-886, May 1999.

Drawbacks with current wideband solutions based on Vivaldi technology is size and performance. The antenna elements are quite large resulting in a much thicker antenna than the traditional dipole based antenna. Also, the scanning angle for traditional Vivaldi technology is sometimes limited and there is sometimes energy radiated at the edges resulting in limited performance. The other wideband technologies like Balanced Antipodal Vivaldi Antenna, BAVA, and Body of Revolution, BOR, has similar problems like traditional Vivaldi technology. Current Sheet Array, CSA, and patch array are quite expensive and patch arrays does not have high bandwidth.

SUMMARY

An object of the present disclosure is to provide an antenna which seeks to mitigate, alleviate, or eliminate one or more of the above-identified deficiencies in the art and disadvantages singly or in any combination.

This object is obtained by a single polarized radiator comprising a plurality of planar notch radiating elements arranged on a dielectric substrate. Each notch radiating element comprises: a metallized region on a first side of the dielectric substrate extending across the width of the notch radiating element from a forward edge of the notch radiating element to a rear edge of the notch radiating element, a tuning element in the metallized region adjacent to a feeding point of the notch radiating element, a notch extending from the tuning element to the forward edge of the notch radiating element thereby creating a notch profile, and a plurality of indentations in the metallized region along each side of the notch to extend the length of the notch profile.

An advantage with the single polarized radiator is a more compact radiator with improved performance than the prior art wideband solutions.

According to an aspect, the indentations are parallel to the rear edge of the notch radiating element.

An advantage with having indentations being parallel with the rear edge is a more compact design.

According to an aspect, the plurality of notch radiating elements share the same metallized region arranged on the dielectric substrate An advantage with sharing the same metallized region is a less costly manufacturing process.

According to an aspect, the single polarized radiator further comprises a first edge element provided adjacent to a first side the plurality of planar notch radiating elements, and a second edge element provided adjacent to a second side, opposite to the first side, of the plurality of planar notch radiating elements. Each edge element has an edge profile extending from the forward edge of an adjacent notch radiating element to the rear edge of the notch radiating element, and at least one meandering section is provided in each edge profile.

An advantage with introducing edge sections to the single polarized radiator is that scanning angle performance and side-lobe performance is improved by reducing edge propagating waves compared to prior art solutions.

The object is also obtained by a single polarized radiator comprising a plurality of planar notch radiating elements arranged on a dielectric substrate. Each notch radiating element comprises: a metallized region on a first side of the dielectric substrate extending across the width of the notch radiating element from a forward edge of the notch radiating element to a rear edge of the notch radiating element, a tuning element in the metallized region adjacent to a feeding point of the notch radiating element, and a notch extending from the tuning element to the forward edge of the notch radiating element thereby creating a notch profile. The single polarized radiator further comprises a first edge element provided adjacent to a first side the plurality of planar notch radiating elements, and a second edge element provided adjacent to a second side, opposite to the first side, of the plurality of planar notch radiating elements. Each edge element has an edge profile extending from the forward edge of an adjacent notch radiating element to the rear edge of the adjacent notch radiating element, and at least one meandering section is provided in each edge profile.

An advantage with the single polarized radiator is that scanning angle performance and side-lobe performance is improved by reducing edge propagating waves compared to prior art solutions.

According to an aspect, a plurality of indentations is provided in the metallized region along each side of the notch of each notch radiating element to extend the length of the notch profile.

An advantage is that a more compact than the prior art wideband solutions.

According to an aspect, the indentations are parallel to the rear edge of the notch radiating element.

An advantage with the indentations being parallel to the rear edge is a more compact design.

According to an aspect, the plurality of notch radiating elements share the same metallized region arranged on the dielectric substrate.

An advantage with sharing the same metallized region is a less expensive manufacturing process.

The object is also obtained by a single polarized broadband antenna comprising at least one single polarized radiator comprising a plurality of planar notch radiating elements arranged on a dielectric substrate according to any of claims 1-16. The rear edge of each notch radiating element is connected to a ground plane and each single polarized radiator is arranged in a first direction.

The object is also obtained by a dual polarized broadband antenna comprising multiple single polarized radiators comprising a plurality of planar notch radiating elements arranged on a dielectric substrate according to any of claims 1-16. The rear edge of each notch radiating element is connected to a ground plane; and at least a first of the multiple single polarized radiators is arranged in a first direction and at least a second of the multiple single polarized radiators is arranged in a second direction, orthogonal to the first direction.

Further aspects and advantages may be found in the detailed description.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Figure 1:
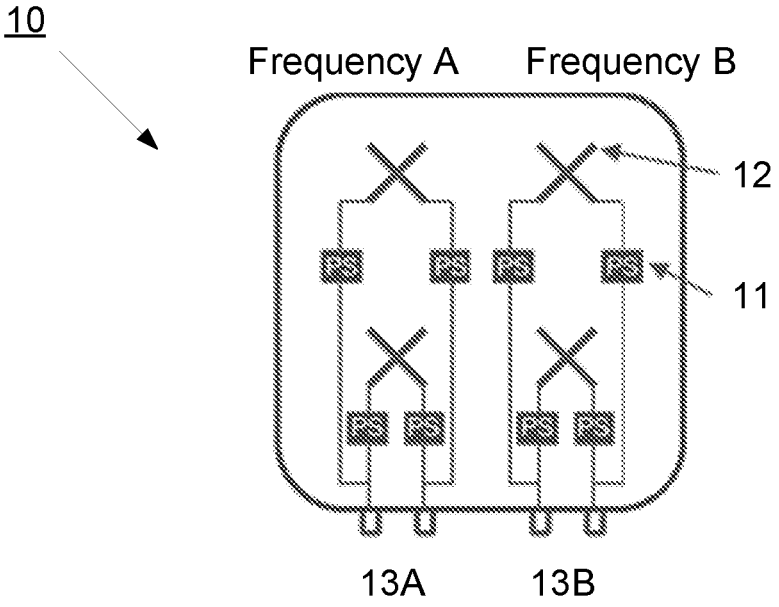
FIG. 1 is a schematic of a dual polarized dual band dipole antenna.

Aspects of the present disclosure will be described more fully hereinafter with reference to the accompanying drawings. The antenna disclosed herein can, however, be realized in many different forms and should not be construed as being limited to the aspects set forth herein. Like numbers in the drawings refer to like elements throughout.

Voltage Standing Wave Ratio, VSWR, is used to illustrate the efficiency of the example embodiments. VSWR is a function of the reflection coefficient, which describes the power reflected from the antenna. If the reflection coefficient is given by Γ, then the VSWR is defined by the following formula:

$$VSWR = \frac{1 + |\Gamma|}{1 - |\Gamma|}$$

The reflection coefficient is also known as s11 or return loss. See the VSWR table 1 below to see a numerical mapping between reflected power, s11 and VSWR.

VSWR table 1 mapping Voltage Standing Wave Ratio with reflection coefficient (s11) and reflected power in % and dB.

| VSWR | $\Gamma_{(s11)}$ | Reflected Power (%) | Reflected Power (dB) |
|---|---|---|---|
| 1.0 | 0.000 | 0.00 | −Infinity |
| 1.5 | 0.200 | 4.0 | −14.0 |
| 2.0 | 0.333 | 11.1 | −9.55 |
| 2.5 | 0.429 | 18.4 | −7.36 |
| 3.0 | 0.500 | 25.0 | −6.00 |
| 3.5 | 0.556 | 30.9 | −5.10 |
| 4.0 | 0.600 | 36.0 | −4.44 |
| 5.0 | 0.667 | 44.0 | −3.52 |
| 6.0 | 0.714 | 51.0 | −2.92 |
| 7.0 | 0.750 | 56.3 | −2.50 |
| 8.0 | 0.778 | 60.5 | −2.18 |
| 9.0 | 0.800 | 64.0 | −1.94 |
| 10.0 | 0.818 | 66.9 | −1.74 |
| 15.0 | 0.875 | 76.6 | −1.16 |
| 20.0 | 0.905 | 81.9 | −0.87 |
| 50.0 | 0.961 | 92.3 | −0.35 |

The terminology used herein is for the purpose of describing particular aspects of the disclosure only, and is not intended to limit the invention. As used herein, the singular forms "a", "an" and "the" are intended to include the plural forms as well, unless the context clearly indicates otherwise.

Some of the example embodiments presented herein are directed towards single polarized radiators. As part of the development of the example embodiments presented herein, a problem will first be identified and discussed.

The proposed solution is based on three components, which may be applied independent of each other:

notch radiating elements with indentations (sometimes called "soft surfaces"),

Wide Angle Impedance Matching, WAIM, layer, and meandering edge elements.

WAIM layer and meandering edge elements can be applied to any wide band technologies, for example the ones mentioned in the background section. The soft surface on radiating element can be applied to some wide-band technologies like Vivaldi and Vivaldi like technologies, for example Body of Revolution, BOR.

The WAIM layer, or sometimes called a lens, is placed over the radiating elements and improves the scanning angle performance. This means the antenna beamforming performance is improved compared to when no WAIM layer is applied.

The purpose of the meandering edge elements is to prevent energy from leaking out on the side rather than radiate in the forward direction. General performance like matching, scanning angle performance is improved by introducing edge elements with a meandering profile, as will be described in connection with FIGS. 3 and 4.

The purpose of introducing indentations (i.e. soft surface) on radiating elements is to reduce the radiating element size. Thus, a broadband antenna comprising radiating elements with indentations may be thinner compared to when no indentations are introduced.

Figure 2:
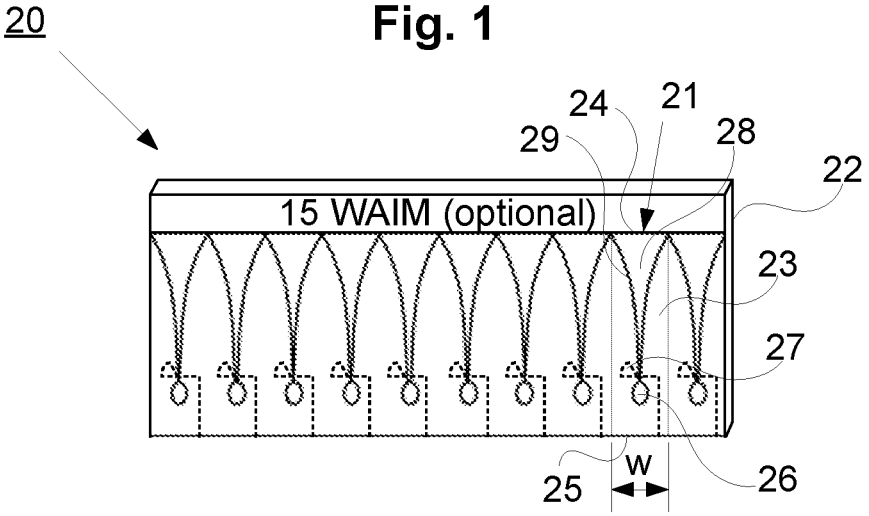
FIG. 2 is a single polarized radiator with notch radiating elements.

FIG. 2 is a single polarized radiator 20 with a plurality of planar notch radiating elements 21, in the example ten notch radiating elements, arranged on a substrate 22. Each notch radiating element 21 comprises a metallized region 23 on a first side of the dielectric substrate 22 extending across the width "w" of the notch radiating element (as indicated by the dotted lines) from a forward edge 24 of the notch radiating element to a rear edge 25 of the notch radiating element, a tuning element 26 in the metallized region 23 adjacent to a feeding point 27 of the notch radiating element. The shape of the tuning element 26 may have different form, such as circular/oval as in Vivaldi or essentially square as in BOR.

Each notch radiating element further comprises a notch 28 extending from the tuning element 26 to the forward edge 24 of the notch radiating element 21 thereby creating a notch profile 29, and which in the example is exponentially tapered, but may have other shapes, such as a stepped profile. According to some aspects, a WAIM layer 15 is included as illustrated in FIG. 2.

Figure 3:
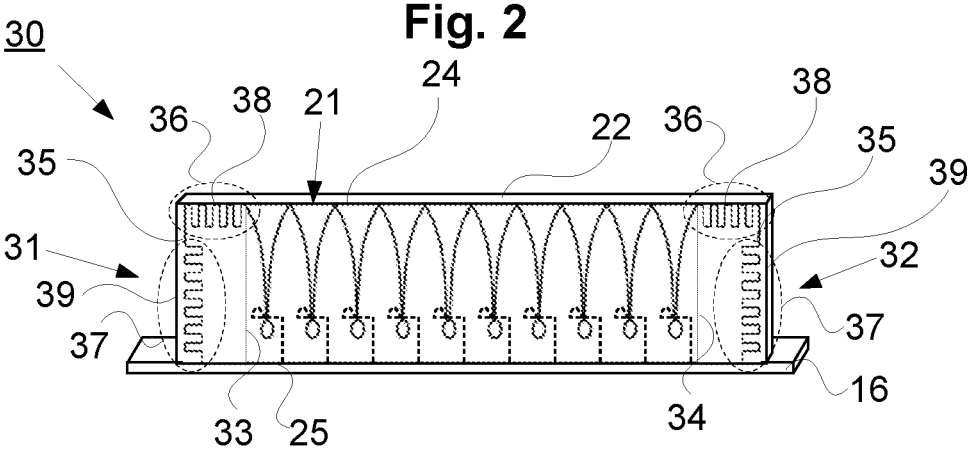
FIG. 3 is a single polarized radiator with notch radiating elements and meandering edge elements.

FIG. 3 is a single polarized radiator 30 with planar notch radiating elements 21 (as described in connection with FIG. 2) and meandering edge elements 31 and 32 to reduce edge propagating waves. A first edge element 31 is provided adjacent to a first side 33 the plurality of planar notch radiating elements 21, and a second edge element 32 is provided adjacent to a second side 34, opposite to the first side 33, of the plurality of planar notch radiating elements 21. Each edge element has an edge profile 35 extending from the forward edge 24 of an adjacent notch radiating element to the rear edge 25 of the adjacent notch radiating element, and wherein at least one meandering section 36, 37 is provided in each edge profile 35.

According to some aspects, a first 36 of the at least one meandering section is provided at a forward edge 38 of each edge element 31, 32 and/or a second 37 of the at least one meandering section is provided at a side edge 39 of each edge element 31, 32 facing away from the adjacent notch radiating element 21.

According to some aspects, the rear edge 25 of the notch radiating element 21 is connectable to a ground plane 16.

According to some aspects, the plurality of notch radiating elements 21 share the same metallized region 23 arranged on the dielectric substrate 22.

Figure 4:
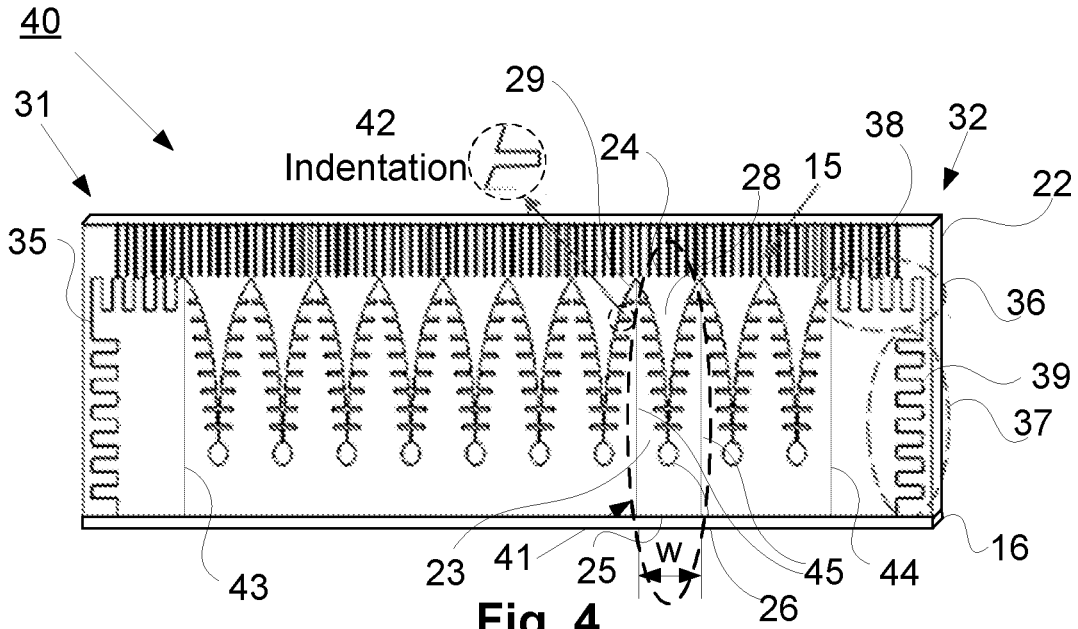
FIG. 4 is a single polarized radiator with notch radiating elements provided with indentations and optional edge elements and WAIM layer.

FIG. 4 is a single polarized radiator 40 with a plurality of planar notch radiating elements 41, in the example ten notch radiating elements, arranged on a substrate 22. Each notch radiating element 41 comprises a metallized region 23 on a first side of the dielectric substrate 22 extending across the width "w" of the notch radiating element (as indicated by the dotted lines) from a forward edge 24 of the notch radiating element to a rear edge 25 of the notch radiating element, a tuning element 26 in the metallized region 23 adjacent to a feeding point (not shown) of the notch radiating element 41. The shape of the tuning element 26 may have different form, such as circular/oval as in Vivaldi or essentially square as in BOR.

Each notch radiating element further comprises a notch 28 extending from the tuning element 26 to the forward edge 24 of the notch radiating element 41 thereby creating a notch profile 29 with a plurality of indentations 42 in the metallized region 23 along each side of the notch 28 to extend the length of the notch profile 29. The indentations allow the radiating wave to propagate within the notch with reduced cross-polarization to other radiating elements in the radiator. The notch profile is, in the example, exponentially tapered, but may have other shapes, such as a stepped profile. It should be noted that the orientation of the indentations for each notch radiating element 41 in relation to the rear edge 24 may be non-parallel with the rear edge 24 and also deviate between adjacent notch radiating elements to achieve different radiating patterns from the radiator 40. Distance between indentations 42 in the notch profile 29 may be arbitrary.

Furthermore, by introducing indentations in the notch profile, the size of the notch radiating element may be reduced, thereby achieving a more compact radiator with improved performance.

According to some aspects an optionally WAIM layer 15 is integrated, as illustrated in FIG. 4.

According to some aspects, the rear edge of each notch radiating element 41 is connectable to a ground plane 16.

According to some aspects, the indentations 42 are parallel to the rear edge 25 of each notch radiating element 41.

According to some aspects, the indentations 42 are evenly distributed along the length of the notch profile 29.

According to some aspects, the plurality of notch radiating elements share the same metallized region 23 arranged on the dielectric substrate 22.

According to some aspects, the single polarized radiator 40 comprises meandering edge elements 31 and 32 to reduce edge propagating waves, as described in connection with FIG. 3. A first edge element 31 is provided adjacent to a first side 43 the plurality of planar notch radiating elements 41, and a second edge element 32 is provided adjacent to a second side 44, opposite to the first side 43, of the plurality of planar notch radiating elements 41. Each edge element has an edge profile 35 extending from the forward edge 24 of an adjacent notch radiating element to the rear edge 25 of the adjacent notch radiating element, and wherein at least one meandering section 36, 37 is provided in each edge profile 35.

According to some aspects, a first 36 of the at least one meandering section is provided at a forward edge 38 of each edge element 31, 32 and/or a second 37 of the at least one meandering section is provided at a side edge 39 of each edge element 31, 32 facing away from the adjacent notch radiating element 41.

The first meandering section 36 will reduce horizontal spatial harmonic frequencies created by edge scattering, and the second meandering section 37 will reduce vertical spatial harmonic frequencies created by edge scattering.

The edge elements will improve the dipole patterns of the active dipoles that are positioned close to the left side and the right side of the single polarized radiator (33 and 34 in FIGS. 3 and 43 and 44 in FIG. 4) since the edge element provide similar environment for all active dipoles. The result is a more symmetric dipole pattern.

Figure 5:
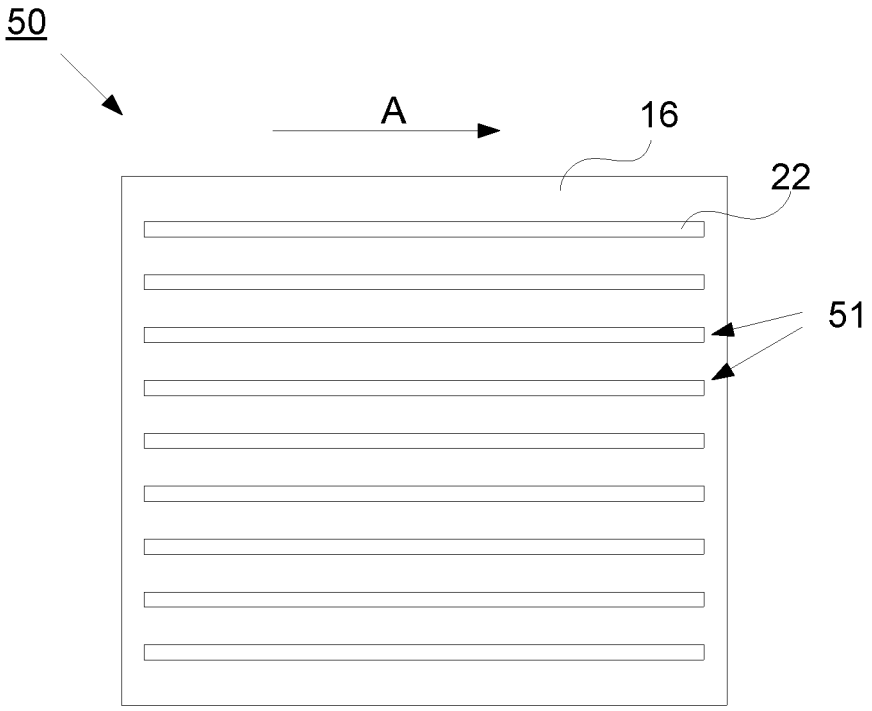
FIG. 5 is a single polarized broadband antenna.

FIG. 5 is a single polarized broadband antenna 50 comprising at least one single polarized radiator 51, in the example eight single polarized radiators. Each single polarized radiator comprises a plurality of planar notch radiating elements, as described in connection with FIGS. 3 and 4, arranged on a dielectric substrate 22. The rear edge 25 of each notch radiating element is connected to a ground plane 16 and each single polarized radiator is arranged in a first direction A.

Figure 6:
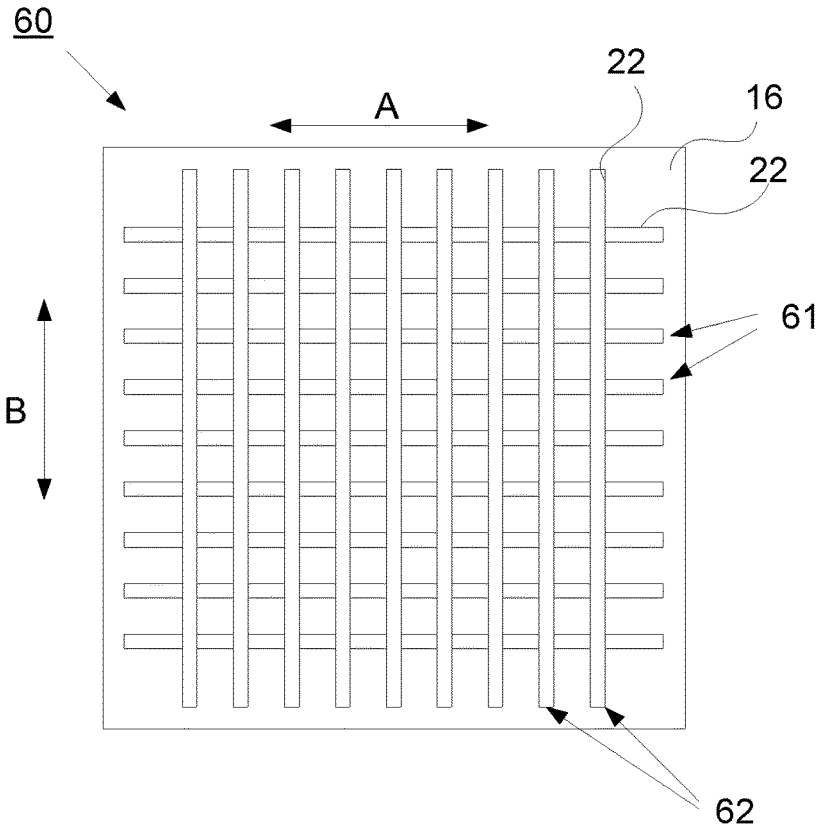
FIG. 6 is a dual-polarized broadband antenna.

FIG. 6 is a dual-polarized broadband antenna 60 comprising multiple single polarized radiators, each comprising a plurality of planar notch radiating elements, as described in connection with FIGS. 3 and 4, arranged on a dielectric substrate 22. The rear edge 25 of each notch radiating element is connected to a ground plane 16; and at least a first 61 of the multiple single polarized radiators is arranged in a first direction A and at least a second 62 of the multiple single polarized radiators is arranged in a second direction B, orthogonal to the first direction A.

Figure 7:
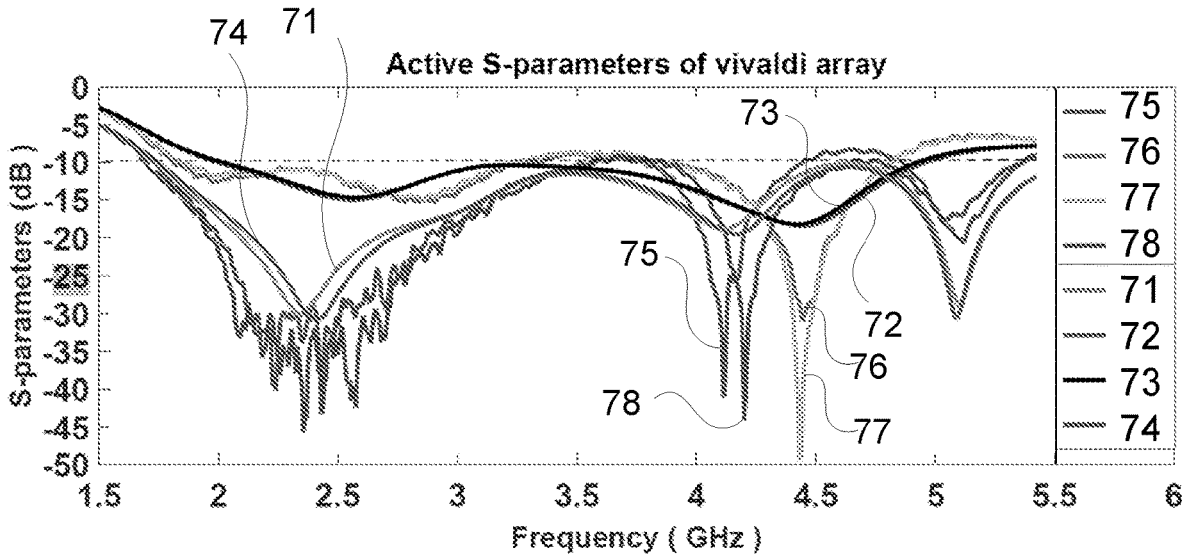
FIG. 7 is a graph illustrating active reflection coefficient for a single polarized radiator with four notch radiator elements and meandering edge elements.

FIG. 7 is a graph illustrating the active reflection coefficient for a single polarized radiator with four notch radiator elements with indentations and meandering edge elements, similar to that illustrated in connection with FIG. 4. The active reflection coefficient was simulated and measured for each notch radiating element, $S_{11}$ for the first notch radiating element, $S_{22}$ for the second notch radiating element, as so on. The single polarized radiator has an operating frequency range of 2 GHz to 5.5 GHz, in which the VSWR is less than 3, i.e. the reflection coefficient <–6 dB.

Curves 71-74 illustrate simulated reflection coefficient and curves 75-78 illustrate measured reflection coefficient. Curves 71 and 75 represent the active notch radiating element closest to the edge element to the left and curve 74 and 78 represent the active notch radiating element closest to the edge element to the right. Curves 72-73 and 76-77 represent the active notch radiating elements in the center of the single polarized radiator.

In the drawings and specification, there have been disclosed exemplary aspects of the disclosure. However, many variations and modifications can be made to these aspects without substantially departing from the principles of the present disclosure. Thus, the disclosure should be regarded as illustrative rather than restrictive, and not as being limited to the particular aspects discussed above. Accordingly, although specific terms are employed, they are used in a generic and descriptive sense only and not for purposes of limitation.

The description of the example embodiments provided herein have been presented for purposes of illustration. The description is not intended to be exhaustive or to limit example embodiments to the precise form disclosed, and modifications and variations are possible in light of the above teachings or may be acquired from practice of various alternatives to the provided embodiments. The examples discussed herein were chosen and described in order to explain the principles and the nature of various example embodiments and its practical application to enable one skilled in the art to utilize the example embodiments in various manners and with various modifications as are suited to the particular use contemplated. The features of the embodiments described herein may be combined in all possible combinations of methods, apparatus, modules, systems, and computer program products. It should be appreciated that the example embodiments presented herein may be practiced in any combination with each other.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

A "wireless device" as the term may be used herein, is to be broadly interpreted to include a radiotelephone having ability for Internet/intranet access, web browser, organizer, calendar, a camera (e.g., video and/or still image camera), a sound recorder (e.g., a microphone), and/or global positioning system (GPS) receiver; a personal communications system (PCS) user equipment that may combine a cellular radiotelephone with data processing; a personal digital assistant (PDA) that can include a radiotelephone or wireless communication system; a laptop; a camera (e.g., video and/or still image camera) having communication ability; and any other computation or communication device capable of transceiving, such as a personal computer, a home entertainment system, a television, etc. Furthermore, a device may be interpreted as any number of antennas or antenna elements.

Although the description is mainly given for a user equipment, as measuring or recording unit, it should be understood by the skilled in the art that "user equipment" is a non-limiting term which means any wireless device, terminal, or node capable of receiving in DL and transmitting in UL (e.g. PDA, laptop, mobile, sensor, fixed relay, mobile relay or even a radio base station, e.g. femto base station).

A cell is associated with a radio node, where a radio node or radio network node or eNodeB used interchangeably in the example embodiment description, comprises in a general sense any node transmitting radio signals used for measurements, e.g., eNodeB, macro/micro/pico base station, home eNodeB, relay, beacon device, or repeater. A radio node herein may comprise a radio node operating in one or more frequencies or frequency bands. It may be a radio node capable of CA. It may also be a single- or multi-RAT node. A multi-RAT node may comprise a node with co-located RATs or supporting multi-standard radio (MSR) or a mixed radio node.

The various example embodiments described herein are described in the general context of method steps or processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

The invention claimed is:

1. A single polarized radiator comprising a plurality of planar notch radiating elements arranged on a dielectric substrate, wherein each notch radiating element of the plurality of planar notch radiating elements comprises:

a metallized region on a first side of the dielectric substrate extending across a width of the notch radiating element from a forward edge of the notch radiating element to a rear edge of the notch radiating element;

a tuning element in the metallized region adjacent to a feeding point of the notch radiating element;

a notch extending from the tuning element to the forward edge of the notch radiating element thereby creating a notch profile; and a plurality of indentations in the metallized region along each side of the notch to extend a length of the notch profile.

2. The single polarized radiator according to claim 1, wherein the rear edge of each notch radiating element is connectable to a ground plane.

3. The single polarized radiator according to claim 1, wherein the indentations are parallel to the rear edge of the notch radiating element.

4. The single polarized radiator according to claim 1, wherein the indentations are evenly distributed along the length of the notch profile.

5. The single polarized radiator according to claim 1, wherein the plurality of notch radiating elements share the same metallized region arranged on the dielectric substrate.

6. The single polarized radiator according to claim 1, wherein a first edge element is provided adjacent to a first side the plurality of planar notch radiating elements, and a second edge element is provided adjacent to a second side, opposite to the first side, of the plurality of planar notch radiating elements, each edge element having an edge profile extending from the forward edge of an adjacent notch radiating element to the rear edge of the adjacent notch radiating element, and wherein at least one meandering section is provided in each edge profile.

7. The single polarized radiator according to claim 6, wherein a first of the at least one meandering section is provided at a forward edge of each edge element.

8. The single polarized radiator according to claim 7, wherein a second of the at least one meandering section is provided at a side edge of each edge element.

9. A single polarized radiator comprising a plurality of planar notch radiating elements arranged on a dielectric substrate, wherein each notch radiating element comprises:

a metallized region on a first side of the dielectric substrate extending across a width of the notch radiating element from a forward edge of the notch radiating element to a rear edge of the notch radiating element;

a tuning element in the metallized region adjacent to a feeding point of the notch radiating element; and a notch extending from the tuning element to the forward edge of the notch radiating element thereby creating a notch profile, wherein a first edge element is provided adjacent to a first side of the plurality of planar notch radiating elements, and a second edge element is provided adjacent to a second side, opposite to the first side, of the plurality of planar notch radiating elements, each edge element having an edge profile extending from the forward edge of an adjacent notch radiating element to the rear edge of the adjacent notch radiating element, and wherein at least one meandering section is provided in each edge profile.

10. The single polarized radiator according to claim 9, wherein a first of the at least one meandering section is provided at a forward edge of each edge element.

11. The single polarized radiator according to claim 10, wherein a second of the at least one meandering section is provided at a side edge of each edge element.

12. The single polarized radiator according to claim 9, wherein the rear edge of each notch radiating element is connectable to a ground plane.

13. The single polarized radiator according to claim 9, wherein a plurality of indentations is provided in the metallized region along each side of the notch of each notch radiating element to extend a length of the notch profile.

14. The single polarized radiator according to claim 13, wherein the indentations are parallel to the rear edge of the notch radiating element.

15. The single polarized radiator according to claim 13, wherein the indentations are evenly distributed along the length of the notch profile.

16. The single polarized radiator according to claim 9, wherein the plurality of notch radiating elements share the same metallized region arranged on the dielectric substrate.

17. A single polarized broadband antenna comprising at least one single polarized radiator comprising a plurality of planar notch radiating elements arranged on a dielectric substrate, wherein each notch radiating element of the plurality of planar notch radiating elements comprising:

a metallized region on a first side of the dielectric substrate extending across a width of the notch radiating element from a forward edge of the notch radiating element to a rear edge of the notch radiating element;

a tuning element in the metallized region adjacent to a feeding point of the notch radiating element;

a notch extending from the tuning element to the forward edge of the notch radiating element thereby creating a notch profile; and a plurality of indentations in the metallized region along each side of the notch to extend a length of the notch profile, wherein the rear edge of each notch radiating element is connected to a ground plane and each single polarized radiator is arranged in a first direction.

18. A dual polarized broadband antenna comprising multiple single polarized radiators comprising a plurality of planar notch radiating elements arranged on a dielectric substrate, wherein each notch radiating element of the plurality of planar notch radiating elements comprising:

a metallized region on a first side of the dielectric substrate extending across a width of the notch radiating element from a forward edge of the notch radiating element to a rear edge of the notch radiating element;

a tuning element in the metallized region adjacent to a feeding point of the notch radiating element;

a notch extending from the tuning element to the forward edge of the notch radiating element thereby creating a notch profile; and a plurality of indentations in the metallized region along each side of the notch to extend a length of the notch profile, wherein the rear edge of each notch radiating element is connected to a ground plane and wherein at least a first of the multiple single polarized radiators is arranged in a first direction and at least a second of the multiple single polarized radiators is arranged in a second direction that is orthogonal to the first direction.

* * * * *